US008638975B2

(12) United States Patent
Jeffery

(10) Patent No.: US 8,638,975 B2
(45) Date of Patent: Jan. 28, 2014

(54) WIPER SEAL FOR PASSIVE RADIATOR

(75) Inventor: Nathan A. Jeffery, Brookline, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 13/211,879

(22) Filed: Aug. 17, 2011

(65) Prior Publication Data

US 2013/0044909 A1 Feb. 21, 2013

(51) Int. Cl.
*H04R 25/00* (2006.01)

(52) U.S. Cl.
USPC ..... 381/398; 381/386; 381/423

(58) Field of Classification Search
USPC ..... 381/182, 353, 354, 368, 386, 392, 398, 381/423, 424, 433, 345, 395; 181/155, 156, 181/171, 172; 379/420.02, 433.02, 432
See application file for complete search history.

(56) References Cited

U.S. PATENT DOCUMENTS

| | | | | |
|---|---|---|---|---|
| 3,612,783 | A | 10/1971 | Schneider | |
| 4,550,429 | A | 10/1985 | Burbank et al. | |
| 4,565,905 | A | 1/1986 | Nation | |
| 4,653,607 | A | 3/1987 | Bage | |
| 5,739,481 | A | 4/1998 | Baumhauer, Jr. et al. | |
| 5,828,766 | A | 10/1998 | Gallo | |
| 5,892,184 | A | 4/1999 | D'Hoogh | |
| 6,058,199 | A | 5/2000 | Umitsu | |
| 6,171,534 | B1 | 1/2001 | Leach et al. | |
| 6,457,547 | B2 | 10/2002 | Novitschitsch | |
| 6,661,902 | B1 | 12/2003 | Ziegler et al. | |
| 7,031,487 | B2 * | 4/2006 | Stiles | 381/398 |
| 2001/0002632 | A1 | 6/2001 | Novitschitsch | |
| 2004/0062407 | A1 | 4/2004 | Ziegler et al. | |
| 2005/0207068 | A1 | 9/2005 | Yao et al. | |
| 2007/0291965 | A1 * | 12/2007 | Noro et al. | 381/182 |

FOREIGN PATENT DOCUMENTS

| | | | |
|---|---|---|---|
| EP | 783238 | A2 | 7/1997 |
| JP | H10-136486 | A | 5/1998 |
| WO | 8602508 | A1 | 4/1986 |
| WO | 9323966 | A1 | 11/1993 |

OTHER PUBLICATIONS

International Search Report and Written Opinion dated Oct. 26, 2012 for International application No. PCT/US2012/050944.

* cited by examiner

*Primary Examiner* — Huyen D Le
(74) *Attorney, Agent, or Firm* — Bose Corporation

(57) ABSTRACT

A method and apparatus for pneumatically sealing an acoustic radiator to an acoustic enclosure. A band of conformable material engages a beveled surface so than an edge of the band deflects outwardly and a surface of the band conforms to the beveled surface.

13 Claims, 8 Drawing Sheets

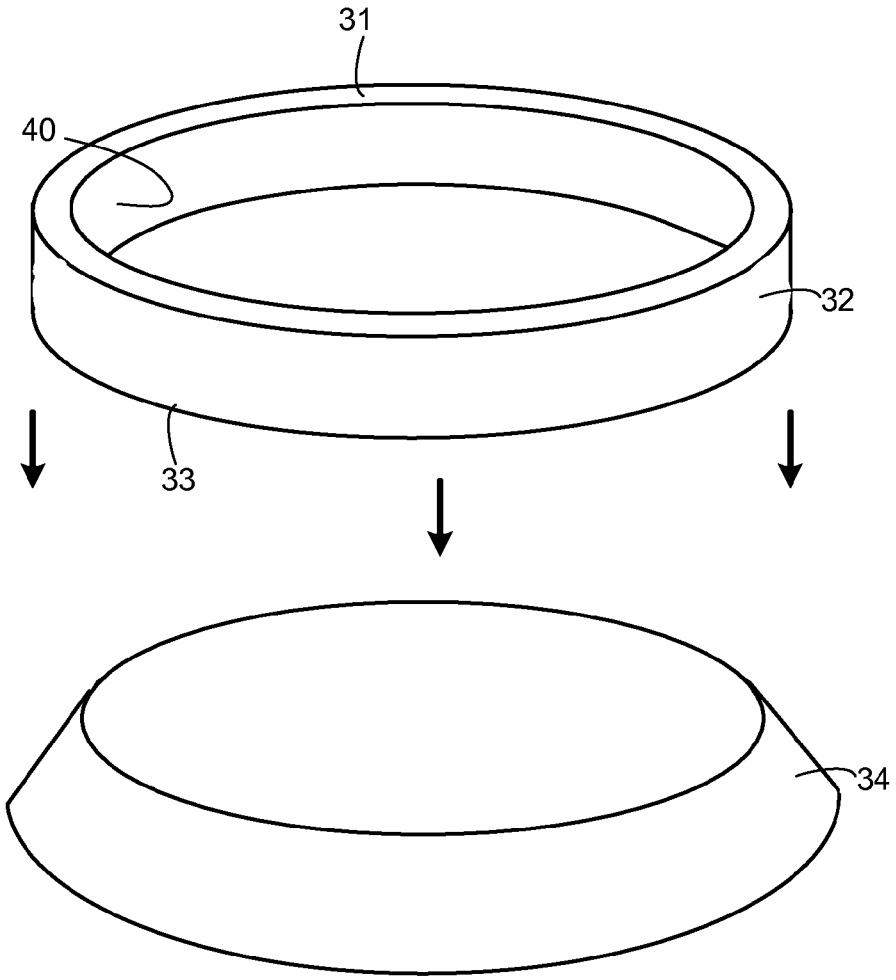
Fig. 8
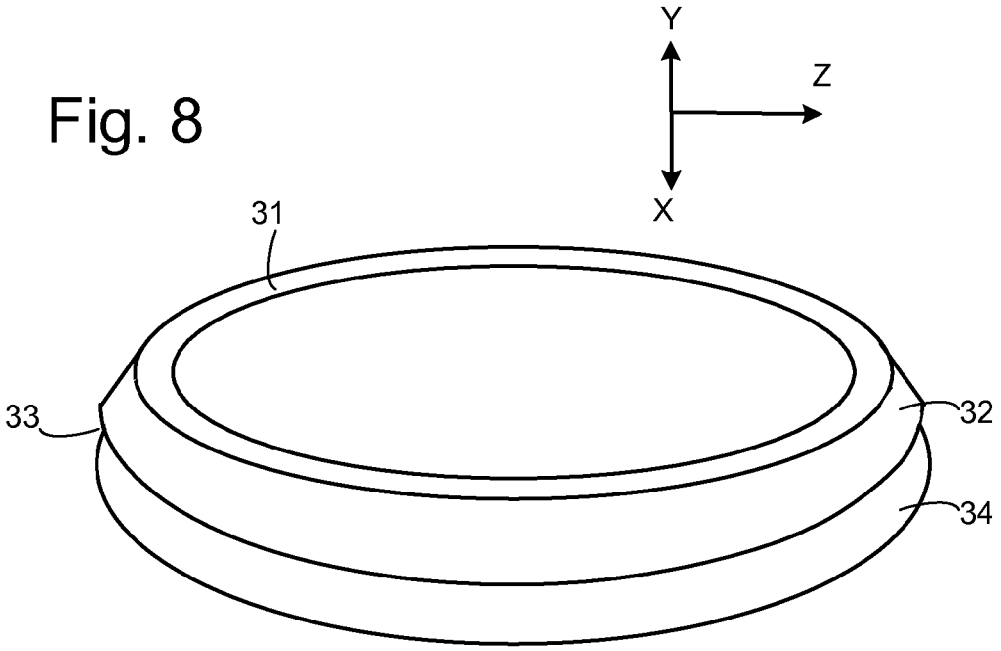

WIPER SEAL FOR PASSIVE RADIATOR

BACKGROUND

This specification concerns acoustic radiator modules, such as acoustic drivers and passive radiators, and methods and apparatus for mounting acoustic radiator modules to acoustic enclosures.

SUMMARY

In one aspect, an apparatus, includes an acoustic radiator structure. The acoustic radiator structure includes an acoustic radiator diaphragm and a suspension element, coupling the acoustic radiator diaphragm to a frame. The acoustic radiator structure is configured to be mechanically coupled to an acoustic enclosure. The apparatus also includes structure to provide a pneumatic seal between the acoustic radiator structure and the acoustic enclosure. The structure to provide a pneumatic seal includes a band of a conformable material, configured so that a surface of the band engages a beveled surface of the acoustic enclosure and conforms to the beveled surface. The band of conformable material may be dimensioned and configured to stretch to engage with and conform to the beveled surface. The band of conformable material may include silicone rubber. The suspension element and the band of conformable material may be a unitary structure. The structure to provide the pneumatic seal may be configured and dimensioned so that when the acoustic radiator structure is not engaged with the acoustic enclosure, the band of conformable material extends substantially perpendicularly from the frame and so that when the acoustic radiator structure is engaged with the acoustic enclosure, the band of conformable material extends obliquely from the frame. The acoustic radiator structure may include an acoustic driver. The acoustic radiator structure may include a passive radiator. The structure to provide the pneumatic seal may be configured so that one edge of the band is constrained and one edge of the band is unconstrained and so that when the unconstrained edge engages the beveled surface, the unconstrained edge deflects outwardly. The band of conformable material and the beveled surface may be planar.

In another aspect, an apparatus, includes an acoustic enclosure and a passive radiator structure mechanically coupled to the acoustic enclosure at an interface. The passive radiator structure includes (a) a frame; (b) a passive radiator diaphragm; and (c) a passive radiator suspension, mechanically coupling the frame and the passive radiator diaphragm. The apparatus also includes structure for pneumatically sealing the interface between the acoustic enclosure and the passive radiator structure. The structure for pneumatically sealing the interface includes a conformable band engaging a beveled surface of the acoustic enclosure so that a surface of the conformable band conforms to the beveled surface. The passive radiator structure and the beveled surface are dimensioned and configured so that an application of a force normal to a plane of the frame results in the application of a force lateral to the frame being exerted on the band causing an unconstrained edge of the band to deflect laterally relative to a constrained edge.

In another aspect, a method includes causing a passive radiator structure to engage with an acoustic enclosure so that a conformable band on the passive radiator structure engages a beveled surface on the acoustic enclosure, causing the conformable band to conform to the beveled surface. The causing may include applying a force normal to a plane of the frame. The applying the force normal to the plane may result in applying a force lateral to the plane of the frame.

Other features, objects, and advantages will become apparent from the following detailed description, when read in connection with the following drawing, in which:

BRIEF DESCRIPTION OF THE SEVERAL VIEWS OF THE DRAWING

FIG. 8 is a simplified mechanical schematic view of elements of the previous views.

DETAILED DESCRIPTION

Figure 1:
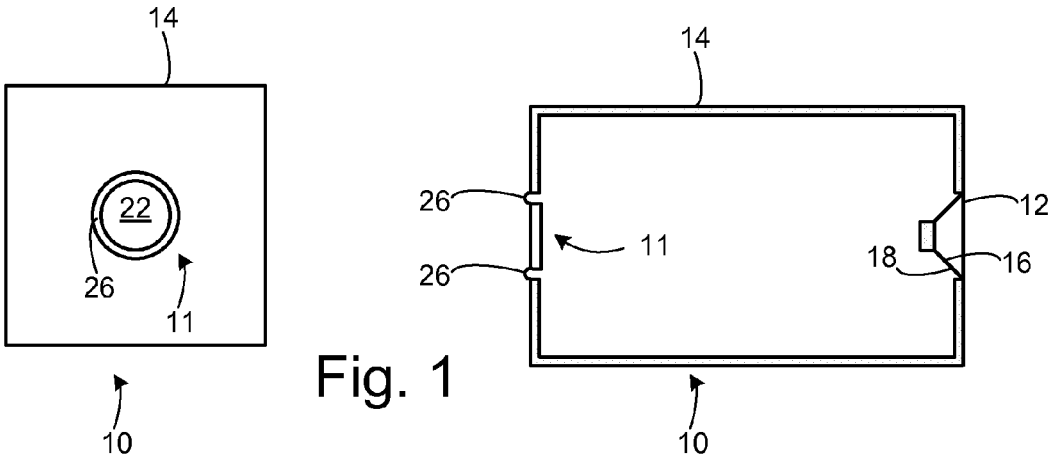
FIG. 1 is a diagrammatic view of a loudspeaker

FIG. 1 shows a loudspeaker system 10. The loudspeaker system 10 includes two acoustic radiating elements, an acoustic driver structure 12 and a passive radiator structure 11. Acoustic driver structure 12 is mounted in an enclosure 14 so that one radiating surface 16 of the acoustic driver structure radiates acoustic energy directly to the environment and one radiating surface 18 of the acoustic driver structure radiates acoustic energy into the enclosure. The passive radiator structure 11 including a passive radiator diaphragm 22 and a suspension element 26 is mounted in the enclosure 14 so that pressure variations in the enclosure cause the passive radiator diaphragm 22 to vibrate, thereby radiating acoustic energy to the environment. For simplicity of explanation, the passive radiator diaphragm 22 is shown as planar and circular. In actual implementations, the passive radiator diaphragm 22 may by non-planar, for example cone shaped, or may be non-circular, for example oval or racetrack shaped. For simplicity of explanation the suspension element is shown as a half-roll surround; however in actual implementations, the suspension element may have a more complex geometry and structure, for example as described in U.S. Pat. No. 7,699,139 and U.S. Pat. No. 7,931,115.

Figure 2:
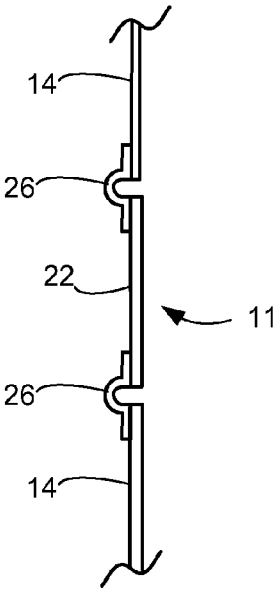
FIGS. 2-4 are diagrammatic views of a structure for sealing an acoustic radiator structure to an enclosure.

FIG. 2 shows one method of mounting the passive radiator structure 11. The passive radiator diaphragm 22 is coupled directly to the enclosure 14 by a surround 26, for example by an adhesive. The surround may be attached to the diaphragm 22 and to the enclosure 14 by an adhesive. The surround forms an pneumatic seal that prevents air from leaking from the interior of the enclosure to the exterior of the enclosure.

Figure 3:
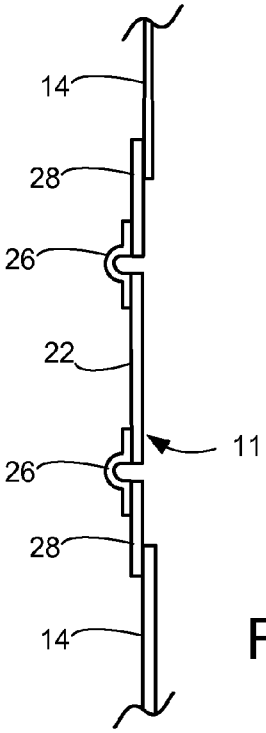
Figure 3:
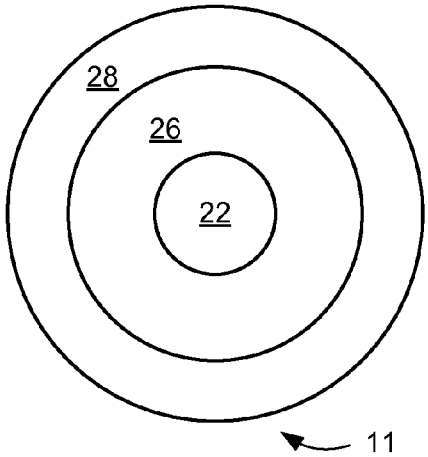

FIG. 3 shows a second method of mounting the passive radiator structure 11. In the configuration of FIG. 3, the passive radiator structure 11 includes a passive radiator diaphragm 22 mounted by a surround 26 to a frame 28, made for example, of a hard plastic, such as polybutylene terephthalate (PBT) with a 30% glass filling. The frame 28 is then mounted to the enclosure, for example by fasteners such as screws. A seal, shown in subsequent views prevents air from leaking from the interior of the enclosure to the environment through the interface between the frame 28 and the enclosure 14.

Figure 4:
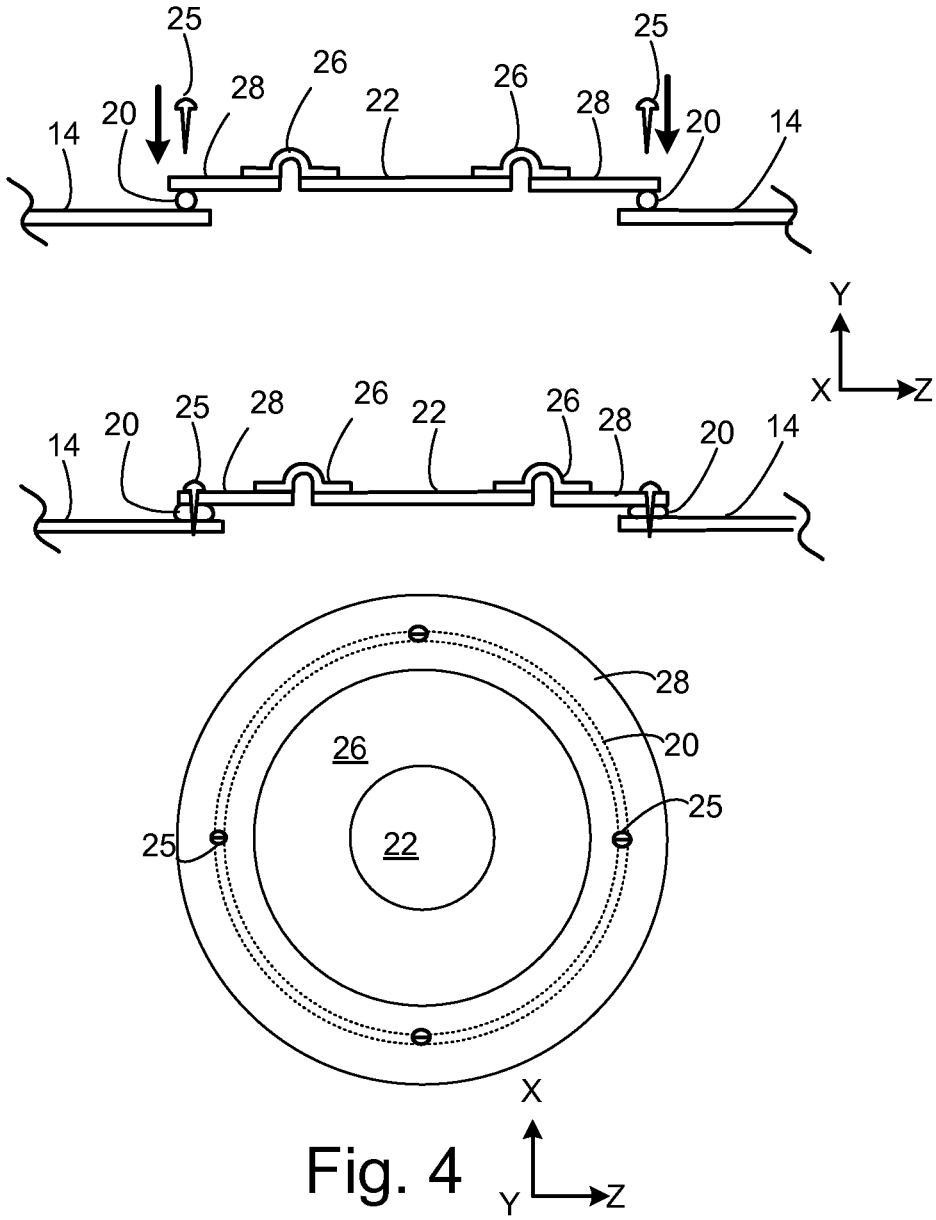

FIG. 4 illustrates the operation of one structure for providing an airtight interface between the frame 28 and the enclosure 14. A seal 20 made of a compressible, conformable, airtight material is positioned between the frame 28 and the enclosure 14. The frame is urged toward the enclosure, for example by fasteners such as screws 25, compressing the seal to form an airtight interface between the enclosure and the frame. The amount of sealed surface between the seal 20 and the frame 28 and between the seal 20 and the enclosure 14 is limited to the dimension of the seal in the X-Z plane. The arrangement of FIG. 4 may have some disadvantages, however. One drawback of the structure shown in FIG. 4 is that the amount of force normal to the plane of the frame 28 and of the wall of the enclosure 14 applied by the fasteners to ensure a good initial seal may cause the frame 28 or the wall of the enclosure 14 to warp or creep, particularly as the passive radiator diaphragm vibrates repeatedly and operates in situations in which the structures are exposed to heat, eventually permitting leaks.

Figure 5A:
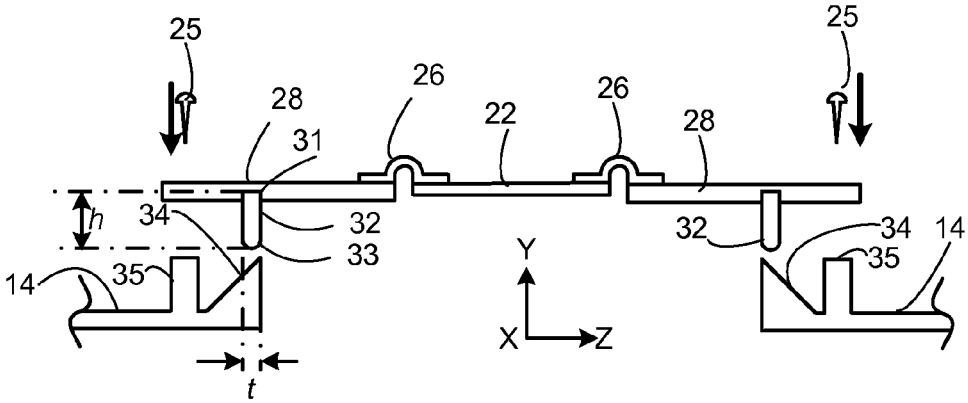
FIGS. 5A and 5B are diagrammatic views of a structure for sealing an acoustic radiator structure to an enclosure.
Figure 5A:
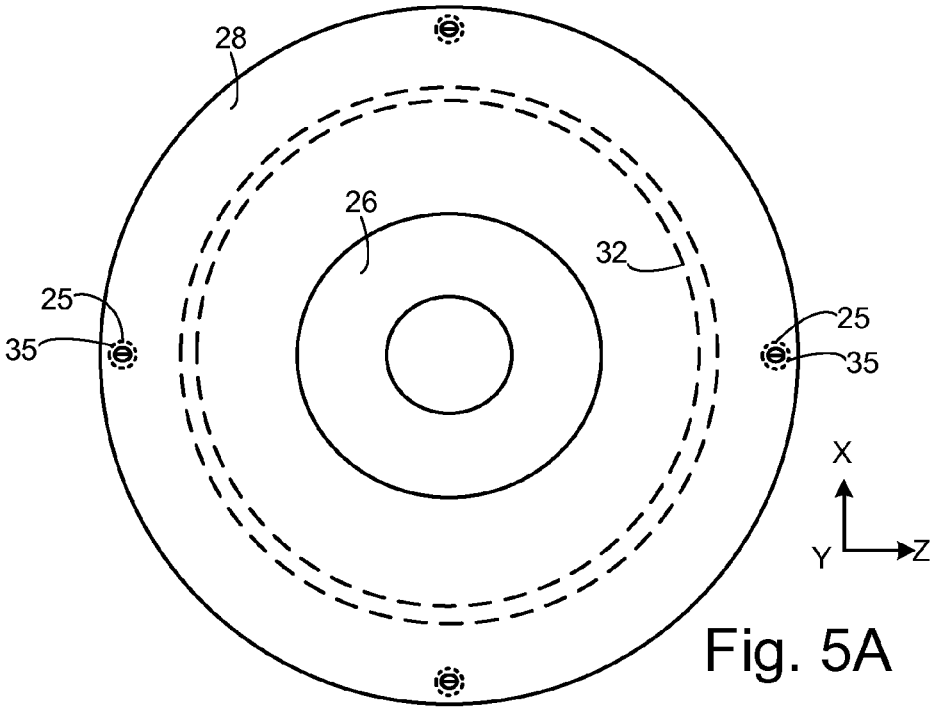
Figure 5B:
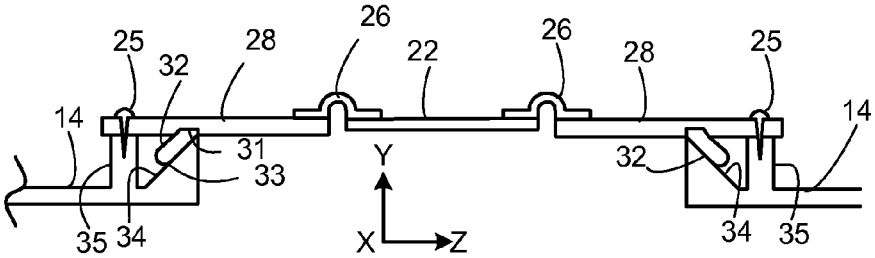
Figure 5B:
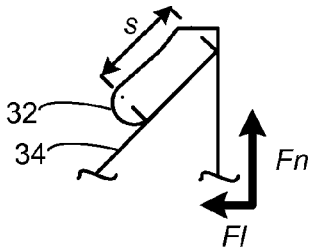
Figure 5B:
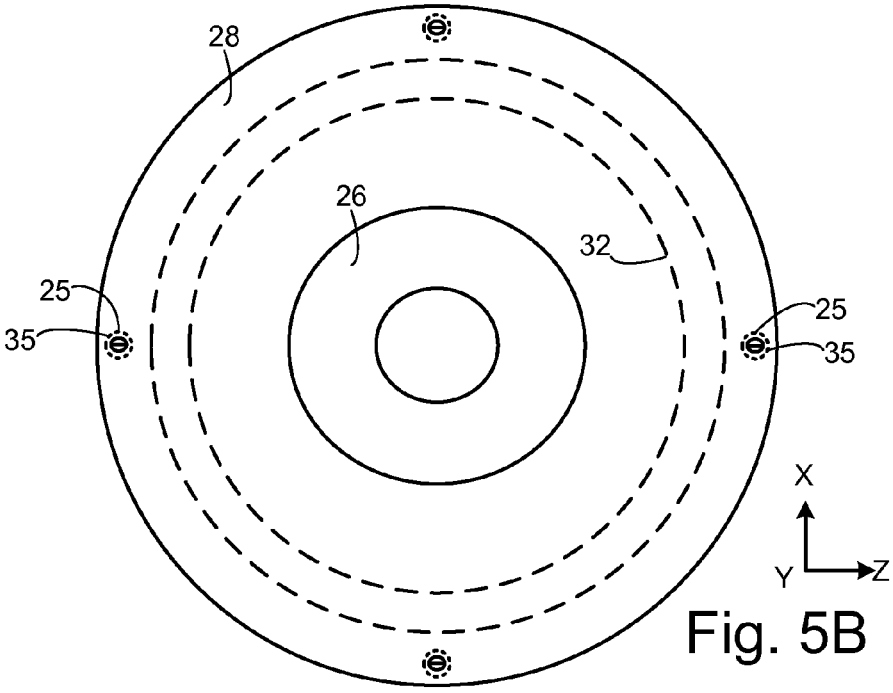

FIGS. 5A and 5B illustrate another structure for providing an airtight interface between the frame 28 and the enclosure 14 and a method for operating that structure. In the structure of FIGS. 5A and 5B, a band or skirt 32 of a conformable, stretchable material, such as a silicone has one edge 31 constrained because it is attached to the frame 28 and one edge 33 unattached and unconstrained. The band 32 is configured and dimensioned to engage with and conform to a beveled edge 34 of the enclosure 14. Preferably, the height h of the band in a direction perpendicular to the surface of the frame 28 is larger than the thickness t of the band. For example, in one implementation, the height h is 3 mm and the thickness t is 2 mm. Some practical limitations to the dimensions may include moldability, manufacturability, and resistance to buckling.

The frame is urged toward the enclosure, for example, by fasteners such as screws 25 that engage standoffs 35 of the enclosure 14, resulting in the configuration of FIG. 5B. The beveled edge causes the force normal to the surface of the frame and the enclosure to be deflected, so that the force applied by the fasteners has both a normal component $F_n$ and a lateral component $F_l$. The lateral force component causes the unattached edge 33 of the band to deflect laterally so that when the assembly including the frame 28 and the band 32 are in an engaged position, as in FIG. 5B, the band extends obliquely from the plane of the frame 28 so that the band 32 conforms to the beveled surface, resulting in a sealed interface between the frame 28 and the enclosure 14 better than, for example, the structure of FIG. 3. The result of the lateral deflection can be seen by comparing the footprint in the X-Z plane of the band 32.

For simplicity of explanation, the components of FIGS. 5A and 5B and FIG. 6 are oriented so that the frame 28 is coupled to an outside surface of the enclosure 14. In other embodiments, the components may be arranged so that the frame is coupled to an inside surface of the enclosure 14. The surface of the band or skirt 32 and the beveled surface 34 are shown as planar, but in other embodiments may be non-planar.

The structure of FIGS. 5A and 5B is advantageous over the structure of FIG. 4 because an airtight seal can be attained with a force having a lower normal force $F_n$ component, thereby reducing the probability of warping caused at least in part by the normal force. Additionally, the structure of FIGS. 5A and 5B provides a better seal if there are non-planarities in the X-Z plane and/or dimensional differences (e.g. manufacturing tolerances) in the Y-direction than the structure of FIG. 4. In addition, the amount of sealed surface s between the band 32 and the beveled surface 34 of the enclosure is not limited to the dimension of the band in the X-Z plane so the amount of sealed surface in the configuration of FIGS. 5A and 5B can be greater than in the configuration of FIG. 4.

Preferably, the band is formed of a material with a Young's modulus in the range of 0.25 MPa to 1.0 MPa, for example 0.5 MPa. Other relevant material properties include tensile strength and percentage elongation at breaking. In one embodiment, the tensile strength is 8.3 MPa and the elongation at breakage is 630%. Other desirable properties include a relatively low coefficient of friction. One material that has these properties is silicone rubber, for example the ELASTOSIL® family of silicone rubbers available from the Wacker Corporation (url www.wacker.com). Since silicone rubber also has properties that make it a desirable material for acoustic driver suspension elements such as surrounds, the structure of FIG. 7 (below) may be employed.

Figure 6A:
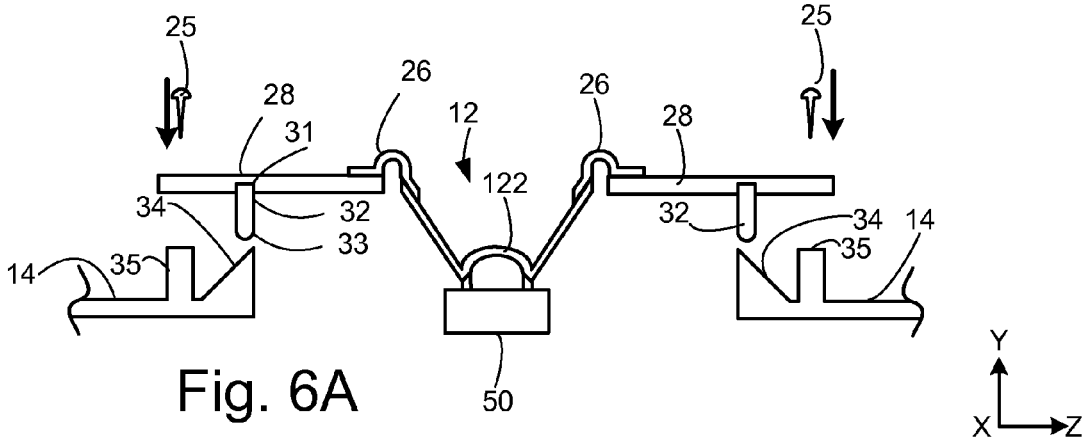
FIGS. 6A and 6B are diagrammatic views of a structure for sealing an acoustic driver structure to an enclosure.
Figure 6B:
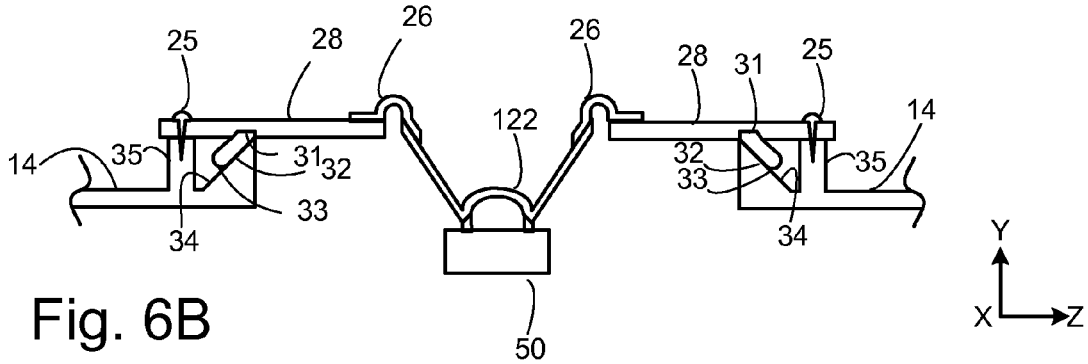

FIGS. 6A and 6B show a structure that could be used for the acoustic driver structure 12 of FIG. 1. The structure of FIGS. 6A and 6B are similar to the structures of FIGS. 5A and 5B, except that the passive radiator structure diaphragm 22 of FIGS. 5A and 5B is replaced by an acoustic driver structure including a cone 122 and a motor structure 50. For simplicity, some elements of a typical acoustic driver structure are omitted. For example, a frame or "basket" (not shown in this view) may mechanically couple the stationary portion of the motor structure 50 to the frame 28. A spider (not shown in this view) may couple the cone 122 to the basket in a manner that permits vibration in the Y-direction but opposes motion in the X and Z-directions.

Figure 7:
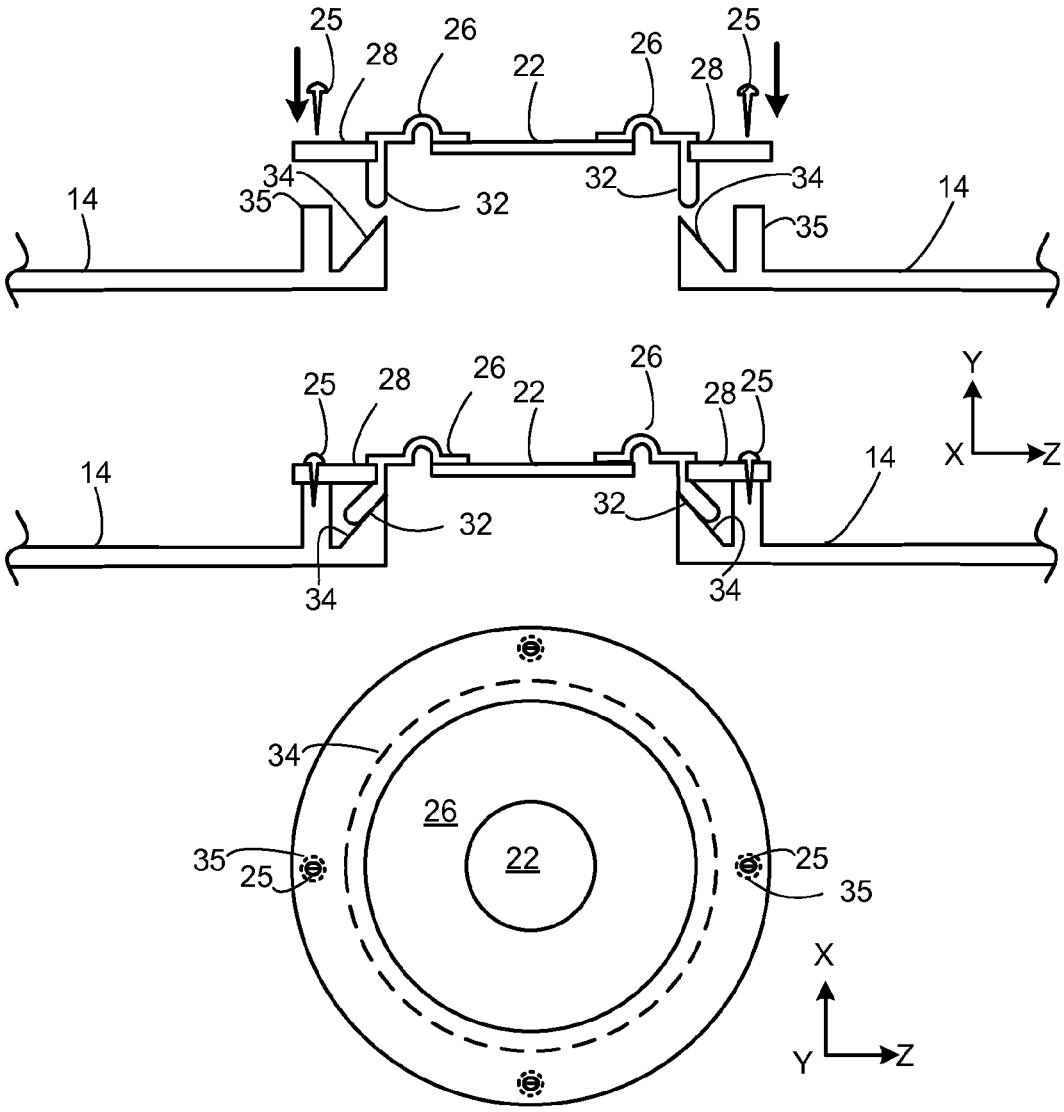
FIG. 7 shows diagrammatic views of a structure for sealing an acoustic driver structure to an enclosure in which the structure for sealing and the diaphragm surround are a unitary structure

In the embodiment of FIG. 7, the suspension element 26 and the band 32 are a unitary structure that engages the frame 28; this permits the suspension element and the band to be formed of in a single, simple, molding operation. The structure of FIG. 7 also permits simpler, more secure geometries for mechanically coupling the frame 28 and the single structure suspension element and band, since portions of the single structure are on both sides of the plane of the frame. The single structure can simply "grab" the frame.

FIG. 8 is a simplified mechanical schematic illustrating the operation of the band 32 and the beveled surface 34. When the assembly including the band 32 is urged toward the beveled surface, the band engages the beveled surface and the inside surface 40 of the band 32 engages the beveled surface 34. The lateral force component $F_l$ of FIG. 5B causes the unattached edge 33 to deflect laterally relative to the attached edge 31 (for simplicity, the frame 28 of previous figures and the attachment between the band 32 and the frame are not shown in this figure) and causes the band 32 to conform to the beveled surface 34, forming the airtight seal.

Figure 9:
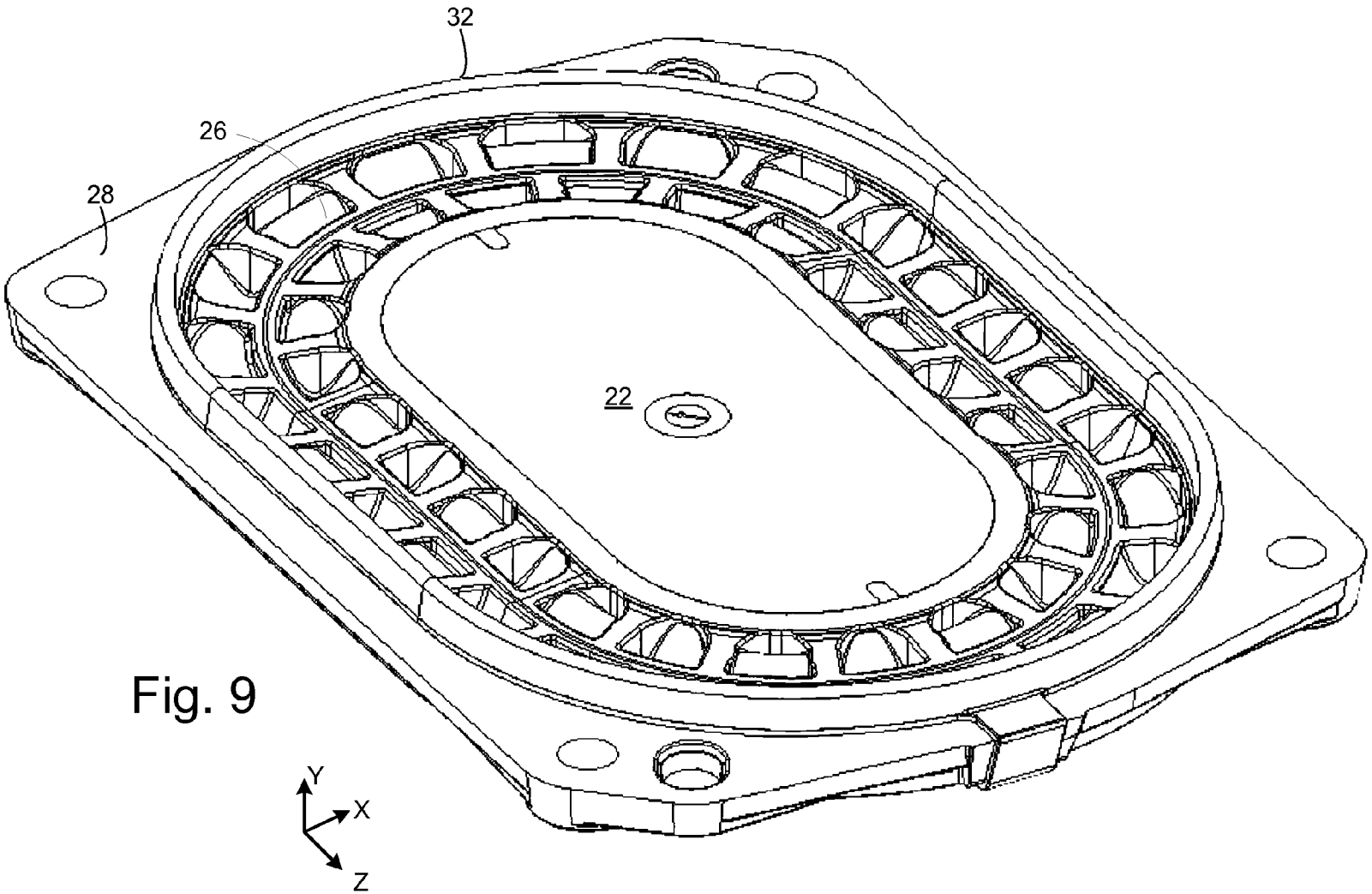
FIG. 9 is an isometric drawing of an implementation of an acoustic driver module according to the previous figures.

FIG. 9 shows an actual implementation of a structure including the frame 28, the surround 26, the band 32, and the passive radiator structure diaphragm 22 according to FIGS. 6A and 6B. In FIG. 9, reference numbers refer to like numbered reference numbers in the previous drawings. In the implementation of FIG. 9, the passive radiator structure diaphragm 22 is racetrack shaped, the surround 26 is according to one or both of U.S. Pat. No. 7,699,139 and U.S. Pat. No. 7,931,115, and the surround 26 and the band 32 are a unitary structure as in FIGS. 6A and 6B.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. An apparatus, comprising:

an acoustic radiator structure, comprising an acoustic radiator diaphragm and a suspension element, coupling the acoustic radiator diaphragm to a frame;

the acoustic radiator structure configured to be mechanically coupled to an acoustic enclosure;

structure to provide a pneumatic seal between the acoustic radiator structure and the acoustic enclosure, comprising a band of a conformable material extending from the structure at a fixed end to a free end and configured so that a surface of the band engages a beveled surface of the acoustic enclosure and the free end of the band configured to deflect laterally to conform to the beveled surface.

2. The apparatus of claim 1, wherein the band of conformable material is dimensioned and configured to stretch to engage with and conform to the beveled surface.

3. The apparatus of claim 1, wherein the band of conformable material comprises silicone rubber.

4. The apparatus of claim 1, wherein the suspension element and the band of conformable material are a unitary structure.

5. The apparatus of claim 1, wherein the structure to provide the pneumatic seal is configured and dimensioned so that when the acoustic radiator structure is not engaged with the acoustic enclosure, the band of conformable material extends substantially perpendicularly from the frame and so that when the acoustic radiator structure is engaged with the acoustic enclosure, the band of conformable material extends obliquely from the frame.

6. The apparatus of claim 1, wherein the acoustic radiator structure comprises an acoustic driver.

7. The apparatus of claim 1, wherein the acoustic radiator structure comprises a passive radiator.

8. The apparatus of claim 1, wherein the structure to provide the pneumatic seal is configured so that one edge of the band is constrained and one edge of the band is unconstrained and so that when the unconstrained edge engages the beveled surface, the unconstrained edge deflects outwardly.

9. The apparatus of claim 1, wherein the band of conformable material and the beveled surface are planar.

10. An apparatus, comprising:

a acoustic enclosure;

a passive radiator structure mechanically coupled to the acoustic enclosure at an interface, the passive radiator structure comprising (a) a frame;

(b) a passive radiator diaphragm; and (c) a passive radiator suspension, mechanically coupling the frame and the passive radiator diaphragm; and structure for pneumatically sealing the interface between the acoustic enclosure and the passive radiator structure, comprising a conformable band extending from the structure at a fixed end to free end and engaging a beveled surface of the acoustic enclosure and the free end of the band configured to deflect laterally to conform to the beveled surface.

11. The apparatus of claim 10, wherein the passive radiator structure and the beveled surface are dimensioned and configured so that an application of a force normal to a plane of the frame results in the application of a force lateral to the frame being exerted on the band causing an unconstrained edge of the band to deflect laterally relative to a constrained edge.

12. A method, comprising:

causing a passive radiator structure to engage with an acoustic enclosure so that a conformable band extending from a fixed end on the passive radiator structure to a free end, engages a beveled surface on the acoustic enclosure, causing the free end of the conformable band to deflect laterally to conform to the beveled surface and provide a substantially pneumatic seal between the passive radiator structure and the acoustic enclosure.

13. The method of claim 12, wherein the causing comprises applying a force normal to a plane of the frame, wherein the applying a force normal to the plane results in applying a force lateral to the plane of the frame.

* * * * *